US005848848A

United States Patent [19]

St. Jean

[11] Patent Number: 5,848,848

[45] Date of Patent: Dec. 15, 1998

[54] BATTERY POWERED PRINTER SYSTEM WITH SELF-CONTAINED HIGH POWER SOLID STATE BATTERY VOLTAGE SWITCHING

[75] Inventor: David L. St. Jean, Chepachet, R.I.

[73] Assignee: Comtec Information Systems, Inc., Warwick, R.I.

[21] Appl. No.: 870,228

[22] Filed: Jun. 6, 1997

[51] Int. Cl.[6] ..... B41J 3/39

[52] U.S. Cl. ..... 400/88; 400/54

[58] Field of Search ..... 400/88, 54

[56] References Cited

U.S. PATENT DOCUMENTS

| | | | |
|---|---|---|---|
| 4,709,248 | 11/1987 | Piatt et al. | 400/175 |
| 5,267,800 | 12/1993 | Petteruti et al. | 400/88 |
| 5,669,720 | 9/1997 | Negishi et al. | 400/120.05 |

*Primary Examiner*—Edgar Burr
*Assistant Examiner*—Steven S. Kelley
*Attorney, Agent, or Firm*—M. Lukacher; K. Lukacher

[57] ABSTRACT

A self-contained, high power, solid state, battery voltage switching system applies battery voltage to a thermal printhead when the printer is turned on and disconnects voltage from the battery to the thermal printhead when the printer is turned off, thereby conserving battery power and increasing battery life. FET switches connect the battery to the printhead and to a circuit for applying operating voltage to a drive and control circuit for the printhead. Gate voltage is applied to the FET, or FETs when a plurality thereof are connected in parallel, to enable the FETs to provide the connection between the battery and the printhead. The gate voltage is supplied from a flip-flop and a FET driver which are self-contained with the FETs and the other circuitry in the printer. Command signals from keys on a keypad or from a computer control unit in the printer or from a communication channel (radio or a communications link) set and reset the flip-flop so that the gate voltage is supplied and the printer is turned on when an on command signal is provided and maintained on until an off command signal occurs.

8 Claims, 1 Drawing Sheet

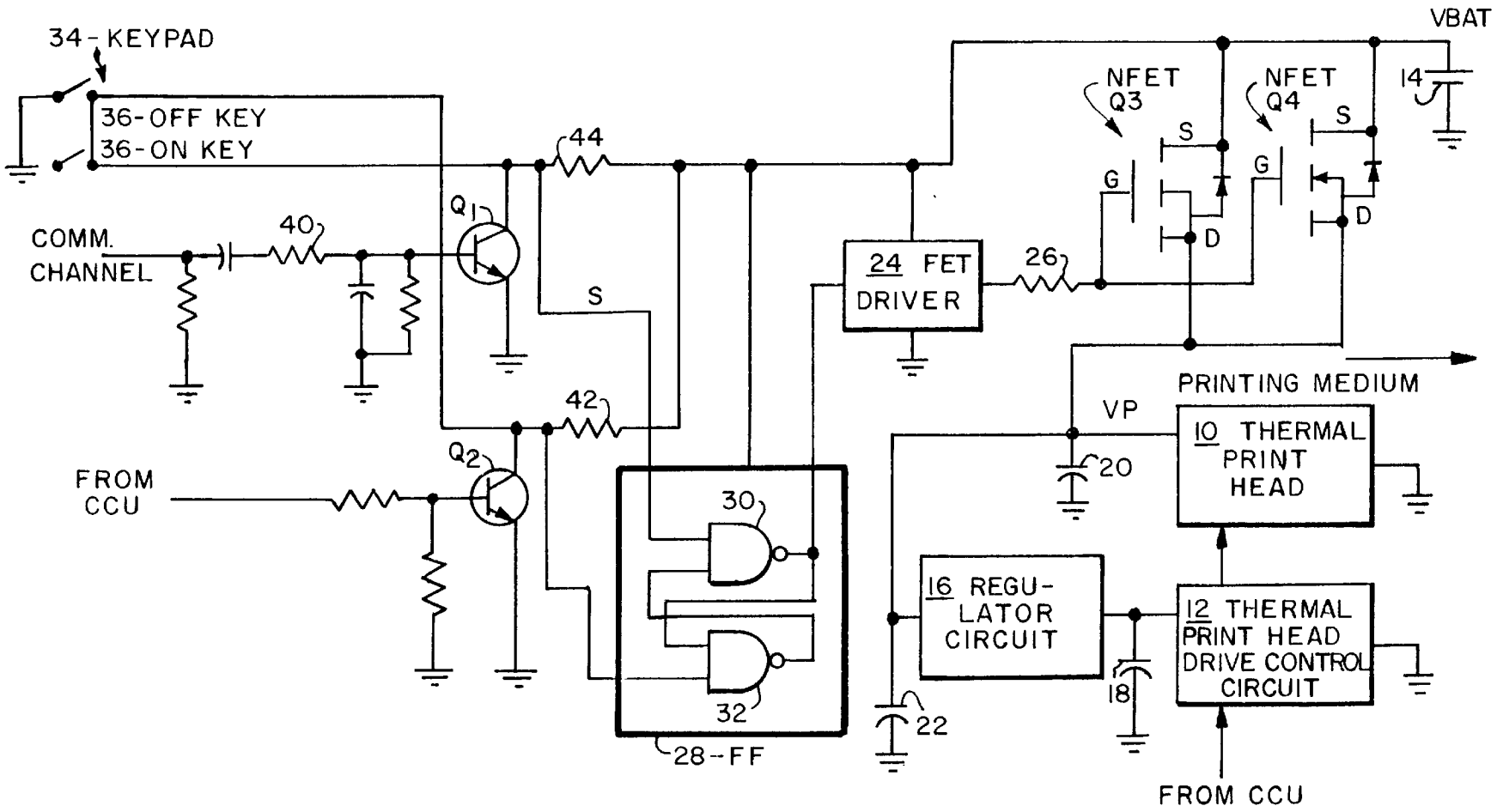
VBAT
14
NFET Q4
NFET Q3
S
D
G
PRINTING MEDIUM
10 THERMAL PRINT HEAD
12 THERMAL PRINT HEAD DRIVE CONTROL CIRCUIT
FROM CCU
VP
20
18
16 REGU-LATOR CIRCUIT
22
26
24 FET DRIVER
30
32
28-FF
44
42
S
Q1
Q2
40
34-KEYPAD
36-OFF KEY
36-ON KEY
COMM. CHANNEL
FROM CCU

BATTERY POWERED PRINTER SYSTEM WITH SELF-CONTAINED HIGH POWER SOLID STATE BATTERY VOLTAGE SWITCHING

The present invention relates to battery powered printer systems and particularly to a self-contained, high power, solid state, battery voltage switching system for controlling the application of power to the printhead and printhead operating circuits of the printer when the printer is turned on and disconnecting the operating voltage when the printer is turned off, thereby conserving battery power and extending battery life in a portable printer.

The invention is especially suitable for use in hand-held portable printers, such as the printer described in Petteruti et al., U.S. Pat. No. 5,285,800, issued Dec. 7, 1993 and in Petteruti. et al., U.S. patent application, Ser. No. 08/819,746, filed Mar. 18, 1997.

Printheads used in battery powered printers draw power from the battery so long as the battery is connected thereto, even when not printing. These printers are usually thermal printheads having printing elements which are heated to print dots or lines on a printing medium such as label or tag stock which is advanced past the printhead and located, as by a platen, in printing relationships therewith. It has been the practice to utilize relays or solid state switches to disconnect the battery from the printhead. Relay switches have the drawback that they use space in the printer and increase the size of the printer which prevents miniaturization of the printer, which is desirable especially for hand-held operation. Another drawback of relay switches is that they fail after installation and use over a large, but unpredictable number of switching cycles. Solid state switches are effective, but complex controls have been used for example, involving the computer control unit of the printer. Moreover, power drain of circuits, such as drive and control circuits, which are associated with the printhead, have not been switched off when the printer is turned off, since such circuits have been required to operate the computer control unit.

Accordingly, it is the principal object of this invention to provide an improved battery powered printer, having self-contained, high power and solid state battery voltage switching circuitry.

It is a further object of the invention to provide, in a printer having a thermal printhead, high power, solid state (FET) battery voltage switching which switches battery voltage not only from the printhead but to other operating circuits of the printer thereby further conserving power by reducing battery drain during periods of time when the printer is turned off.

It is a still further object of the present invention to provide a miniaturized and battery powered printer with a self-contained, solid state, high power battery voltage switching circuit which is simpler and less complex than circuits involving the use of computer control units of the printer.

BRIEF DESCRIPTION OF THE DRAWINGS

The figure shows the battery voltage switching circuit of the present invention.

Briefly described, a battery-powered printer system embodying the invention, uses a printhead, such as a thermal printhead, which draws power from a battery when battery voltage is applied thereto. A drive and control circuit enables the printhead to print when operating voltage is applied to that circuit. Printing occurs when a medium, such as a web, is disposed in printing relationship with the printhead. A solid state switch including at least one FET is connected between the battery and printhead and also between the battery and the drive and control circuit. The switch enables the battery to apply the battery voltage to the printhead and also enables the battery to supply operating voltage to the drive and control circuit. The FET has a gate which is responsive to gating voltage, which is applied via a circuit such as a flip-flop and a FET driver. This circuit maintains the gating voltage, as in response to command signals which turn the printer on, until command signals turn the printer off, thereby switching off the battery voltage to the printhead and its drive and control circuit to conserve battery power when the printer is turned off. The command signals may be obtained from a keypad on the printer, a radio or another communications link from a host. The command signals to turn the printer off may be time-out signals from the computer control unit of the printer. The computer control unit provides printing signals via the drive and control circuits to the printhead in accordance with computer programs which are contained in the computer control unit or elsewhere in the printer.

The foregoing and other objects features and advantages of the invention, as well as a presently preferred embodiment thereof, will become apparent from a reading of the following description in connection with the accompanying drawing which is a sole figure showing a schematic diagram of a battery powered printer system embodying self-contained, high power, solid state, battery voltage switching circuits, which are provided in accordance with the invention.

Referring to the drawing, there is shown a printing medium in printing relationship with a thermal printhead (TPH) 10. The elements of the printhead are enabled to print by TPH drive and control circuit 12. The printhead and its drive and control circuit may be similar to those described in the above-referenced Petteruti Patent and Patent Application. The drive and control circuits may be self-contained with the other circuits show on the same printed circuit board. The thermal printhead may be mounted on this board or be connected thereto via a cable, preferably in close proximity to the board. Accordingly, all of the circuitry which controls the thermal printhead and switches power thereto from a battery 14 are self-contained, with the thermal printhead, in the printer.

The TPH drive and control circuits 12 receive operating voltage ($V_c$) from a regulator circuit 16 which may be a commercially-available regulator. $V_c$ is filtered by an electrolytic capacitor 18. The operating voltage enables the circuits 12 to control the TPH 10 in response to digital inputs from the computer control unit (CCU) of the printer.

The battery voltage (VBAT) is switched by a solid state switching device. The solid state switching device is preferably a pair of N-channel power MOSFETs, $Q_3$ and $Q_4$. These FETs have gates (G), sources and drains (S) and (D) and are connected to the battery 14. The switched voltage is filtered by an electrolytic capacitor 20 and applied to the thermal printhead 10 as $V_p$ .

The connection through the FETs $Q_3$ and $Q_4$ is enabled by gate voltages applied to the gates of the FETs and maintaining that gate voltage so long as the printer is to be turned on for printing. This gate voltage is generated in an FET driver 24, which may be a LTC 1154 high-side micro power MOSFET driver which is available from Linear Technology Corporation, 1630 McCarthy Boulevard, Milpitas, Calif. USA 95035 or other similar driver circuit which enhances, thereby turning on, the FETs. The driver 24 receives a digital level which causes the driver 24 to provide a positive voltage to the gates of the FETs $Q_3$ and $Q_4$ through a resistor 26 from the output indicated as Q of a flip-flop (FF) 28. The flip-flop 28 is provided by cross-connected NAND gates 30 and 32. The inputs to the gate 30 sets the flip-flop, while an input to the gate 32 resets the flip-flop.

Command signals for turning the printer on and off are applied to the set and reset inputs (S) and (R) of the flip-flop 28. The signals may be generated by a keypad 34 of the printer which has off and on keys 36 and 38. When the key 36 is depressed, a pulse of voltage is generated due to the drop across a resistor 44 which sets the flip-flop 28. Then the Q output goes high (with respect to ground) so as to operate the FET driver 24 to generate the gate drive voltage, thereby turning the FETs $Q_3$ and $Q_4$ on and putting the printer into printing condition (its on state).

A command signal to turn the printer on may also come from a command channel such as may be connected to the DTR line or the RXD line of a RS-232 link or a radio, or an IR (infrared) receiver. The signal from the link, radio or the receiver is filtered in an RC filter 40 which connects the communication channel to the base of an NPN transistor $Q_1$. When the transistor $Q_1$ receives a pulse from the command channel to place the printer in its on state, a current pulse through the resistor 44 sets the flip-flop 28. The flip-flop 28 then operates the driver 24 and provides the connection through the FETs $Q_3$ and $Q_4$ as explained above.

The set condition of the flip-flop is maintained until a command signal to turn the printer off is received which resets the flip-flop 28. This command signal is obtained either from an off key 38 on the keypad 34, or from the computer control unit, suitably if there has been no printing going on for a time-out period. A resistor 42 applies the battery voltage to another NPN transistor $Q_2$ when that transistor is rendered conducted by a pulse from the CCU. A pulse is also obtained which resets the flip-flop when the push button 38 is depressed and a pulse of current flows to ground through the push button switch 38 via the resistor 42.

The command signal generating circuits are continually connected to the battery and receive VBAT. Also the flip-flop and the FET driver receives VBAT. These circuits draw very small currents, on the order of microamps and do not significantly decrease the battery life. The major draw from the battery, which may be a 7 to 12 volt power source of high current capacity, is the thermal printhead which provides a milliamp draw even when not printing. When not printing, the thermal printhead, the regulator circuit 10 and the driver and control circuit 12 are disconnected from the battery, thereby providing a significant power conservation and life enhancement of the battery.

Variations and modifications in the herein-described system, within the scope of the invention, will undoubtedly suggest themselves to those skilled in the art. Accordingly, the foregoing description should be taken as illustrative and not in a limiting sense.

I claim:

1. A battery powered printer system which comprises a printhead which draws power from the battery when battery voltage is applied thereto, a drive and control circuit which when operating voltage is applied thereto enables the printhead to print indicia on a medium when said medium is disposed in printing relationship therewith, at least one FET switch connected between said battery and said printhead and said drive and control circuit to enable said battery to apply said battery voltage to said printhead and to enable said battery to supply operating voltage to said drive and control circuit, and means independent of said circuit for applying gate voltage to said FET and maintaining said gate voltage for connecting said battery via said FET to apply said battery voltage to said printhead and to apply said operating voltage to said drive and control circuit when said printer is enabled to print with said printhead, and wherein said gate voltage applying means are self-contained with said FET switch, and with means for applying command signals to said gate voltage applying means for turning said printer on and off, said printer being enabled to print when on, and wherein said gate voltage applying means comprises solid state circuits, including a flip-flop circuit and an FET driver, both connected to said battery, said flip-flop being connected to said FET driver, and means for applying said command signals to set and reset said flip-flop for turning said printer on and off.

2. The system according to claim 1 wherein said printer has a keypad and means using said battery voltage for providing said command signals.

3. The system according to claim 2 wherein said printer has a computer control unit for providing, said battery voltage, at least one of said command signals, to reset said flip-flop.

4. The system according to claim 3 wherein said FET switch comprises one or a plurality of parallel-connected FETs.

5. The system according to claim 1 further comprising a regulator circuit connected to said battery via said FET to provide said operating voltage for said drive and control circuit.

6. The system according to claim 1 wherein said printhead is a thermal printhead.

7. A battery powered printer system which comprises a printhead which draws power from the battery when battery voltage is applied thereto, a drive and control circuit which when operating voltage is applied thereto enables the printhead to print indicia on a medium when said medium is disposed in printing relationship therewith, at least one FET switch connected between said battery and said printhead and said drive and control circuit to enable said battery to apply said battery voltage to said printhead and to enable said battery to supply operating voltage to said drive and control circuit, and means independent of said circuit for applying gate voltage to said FET and maintaining said gate voltage for connecting said battery via said FET to apply said battery voltage to said printhead and to apply said operating voltage to said drive and control circuit when said printer is enabled to print with said printhead, and wherein said gate voltage applying means are self-contained with said FET switch, and with means for applying command signals to said gate voltage applying means for turning said printer on and off, said printer being enabled to print when on, and wherein said drive and control circuit is also self-contained with said FET switch and said gate voltage applying means and with a regulator circuit connected to said battery via said FET for providing said operating voltage.

8. The system according to claim 7 wherein said printhead is a thermal printhead.

* * * * *